US006523978B1

(12) United States Patent
Huang

(10) Patent No.: US 6,523,978 B1
(45) Date of Patent: Feb. 25, 2003

(54) LAMP BULB WITH STRETCHABLE LAMP BEADS THEREIN

(75) Inventor: Peter K. H. Huang, Taipei (TW)

(73) Assignee: Shining Blick Enterprises Co., Ltd., Taipei (TW)

( * ) Notice: Subject to any disclaimer, the term of this patent is extended or adjusted under 35 U.S.C. 154(b) by 0 days.

(21) Appl. No.: 09/698,029

(22) Filed: Oct. 30, 2000

(51) Int. Cl.[7] ..... F21S 13/14

(52) U.S. Cl. ..... 362/252; 362/800; 362/240; 362/249; 362/250; 362/238; 362/239; 313/500; 313/512

(58) Field of Search ..... 362/800, 240, 362/252, 249, 250, 238, 239; 313/500, 512

(56) References Cited

U.S. PATENT DOCUMENTS 2,002,775 A * 5/1935 Henninger, Jr.
4,161,021 A * 7/1979 George, Jr. ..... 362/252
4,727,289 A * 2/1988 Uchida ..... 315/71
5,655,830 A * 8/1997 Ruskouski ..... 362/240
5,749,646 A * 5/1998 Brittell ..... 362/231
5,806,965 A * 9/1998 Deese ..... 362/249
6,220,722 B1 * 4/2001 Begemann ..... 362/231

* cited by examiner

*Primary Examiner*—Sandra O'Shea
*Assistant Examiner*—Jacob Y. Choi
(74) *Attorney, Agent, or Firm*—Troxell Law Office PLLC

(57) ABSTRACT

A lamp bulb having a core column and a plurality of internally stretching miniature lamp beads therein, wherein the lamp bulb has on one end thereof a metallic cap. The core column is connected with an elastic frame by means of guide posts; the elastic frame can be elastically stretched as per its own nature and can be in any of various types. The miniature lamp beads are arranged on the elastic frame. The elastic frame can be bent to make its width reduced to be able to place into the lamp bulb via the opening thereof, the elastic frame and the miniature lamp beads can be stretched into a predetermined shape in the lamp bulb. Thereby, limitation of opening of a glass lamp bulb as before can be gotten rid off, the space in the lamp bulb can be used as far as it can be to construct a more attractive decoration effect with many light spots.

4 Claims, 6 Drawing Sheets

LAMP BULB WITH STRETCHABLE LAMP BEADS THEREIN

BACKGROUND OF THE INVENTION

1. Field of the invention

The present invention is related to a lamp bulb having a core column and a plurality of internally stretching miniature lamp beads therein, and especially to a lamp bulb getting rid of the limitation of small opening of a conventional glass lamp bulb and having a plurality of light emitting articles such as miniature lamp beads or LEDs therein stretching into any of various shapes.

2. Description of the Prior Art

A conventional lamp bulb has in the hard glass housing thereof a tungsten filament hermetically connected with two metallic conductors, electric current flows through the tungsten filament with a predetermined length to get the function of light emitting. Since invention of the first lamp bulb in the history, lamp bulbs have been widely used in various illumination purposes; beside this, the conventional lamp bulbs also have been being used in large amount for decoration.

By providing a tungsten filament in a conventional lamp bulb, the lamp bulb only gives a single light spot; it is inadequate as for the effect of decoration. Thereby, a design was proposed to have a plurality of miniature lamp beads in a glass lamp bulb to provide multiple light spots in a single glass lamp bulb when electricity is turned on. The structure of such decorative lamp bulb is shown in FIG. 1. The lamp bulb is provided basically on the top end of a glass lamp bulb 10 with a metallic cap 11 which is screw-connected for electricity connection; it is different from an ordinary lamp bulb in that it has therein a core column 12 used for connecting with the conductors, and in addition, the core column 12 has a vertical guide post 13 extending for a predetermined length for positioning of a plurality of miniature lamp beads 14 arranged centrally and other miniature lamp beads 15 on both sides of the central miniature lamp beads 14. Thereby, when electricity is turned on, a plurality of light spots can be given in the glass lamp bulb 10.

Such a conventional lamp bulb with a plurality of light spots is deficient in that, the shape and the mode that the interior miniature lamp beads are placed in the glass lamp bulb 10 is limited by the width of the opening of the latter, an advanced lightening modeling is very difficult to be designed. By virtue that a neck 16 on the junction between the glass lamp bulb 10 and the metallic cap 11 during, manufacturing has a small diameter, the width "W" of the opening before assembling of the metallic cap 11 is far less than tie largest diameter of the glass lamp bulb 10. In designing, the c re column 12 and the miniature lamp beads 14, 15 in the lamp bulb 10 must have their diameter smaller than the width "W" of the opening. Under limitation of such a condition, the miniature lamp beads which generate light spots must be formed as lengthy trips in order to be placed into the lamp bulb 10. And the who e decoration fashion of lamp-strings created by the light spots Mill be monotonic.

SUMMARY OF THE INVENTION

The object of the present invention is to provide a lamp bulb having a core column and a plurality of internally stretching miniature lamp beads therein, the miniature lamp beads placed therein can be stretched as far as they can be in any of various modes in pursuance of the internal space of the lamp bulb.

To get the object, a core column of the present invention is provided with guide posts extending for connecting with a flexible elastic frame, a plurality of miniature lamp beads generating light spots can be arranged on the elastic frame. The elastic frame can be elastically stretched as per its own nature and can be in any of various types such as a ring, a heart or a star. The elastic frame can be bent to make its width reduced to be able to place into the lamp bulb via the opening of thereof, the elastic frame and the miniature lamp beads thereon can be stretched into a predetermined shape in the lamp bulb after passing the opening.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
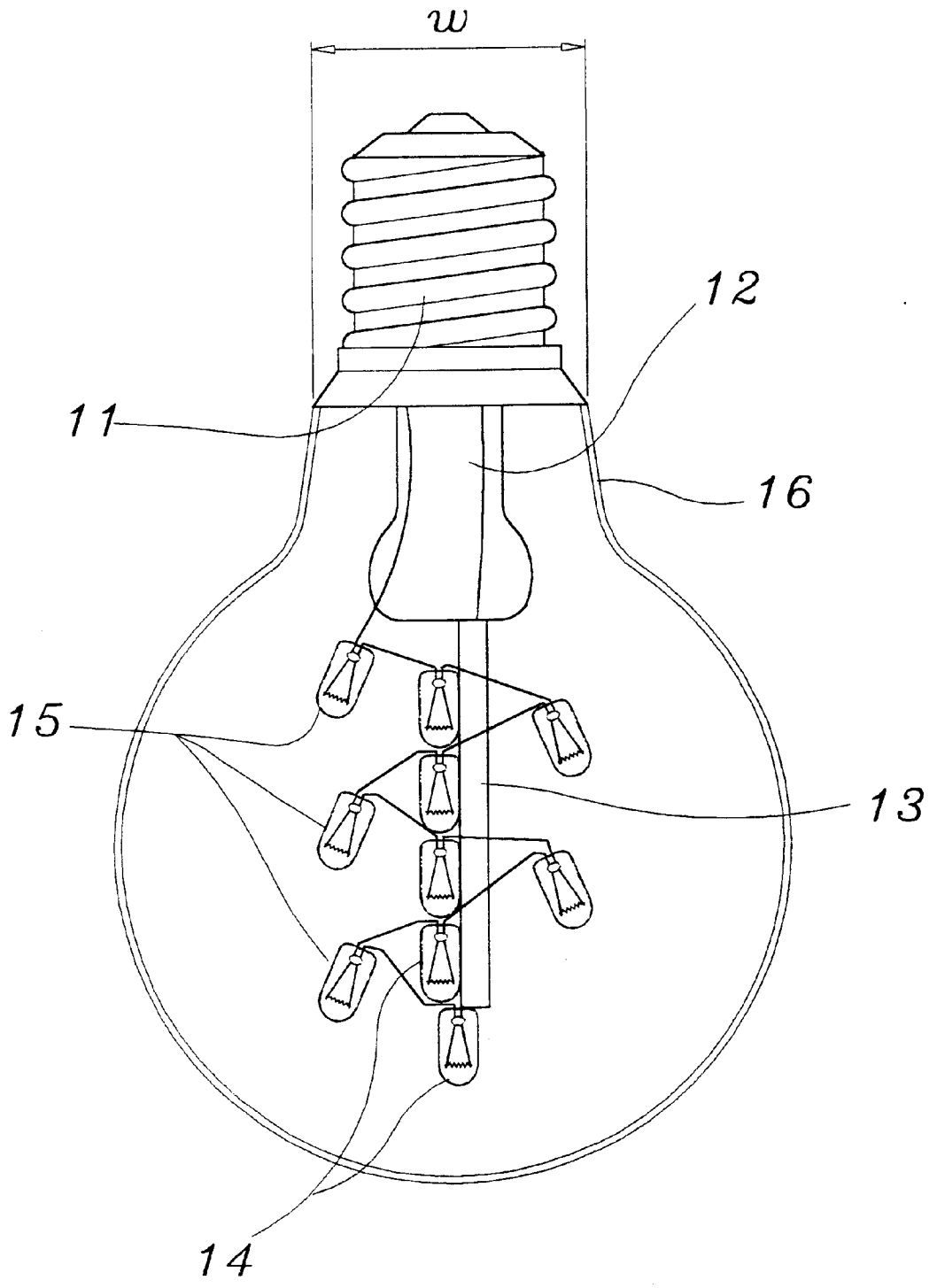
PRIOR ART FIG. 1
FIG. 1 is a perspective view showing the structure of a conventional lamp bulb with miniature lamp beads.
Figure 2:
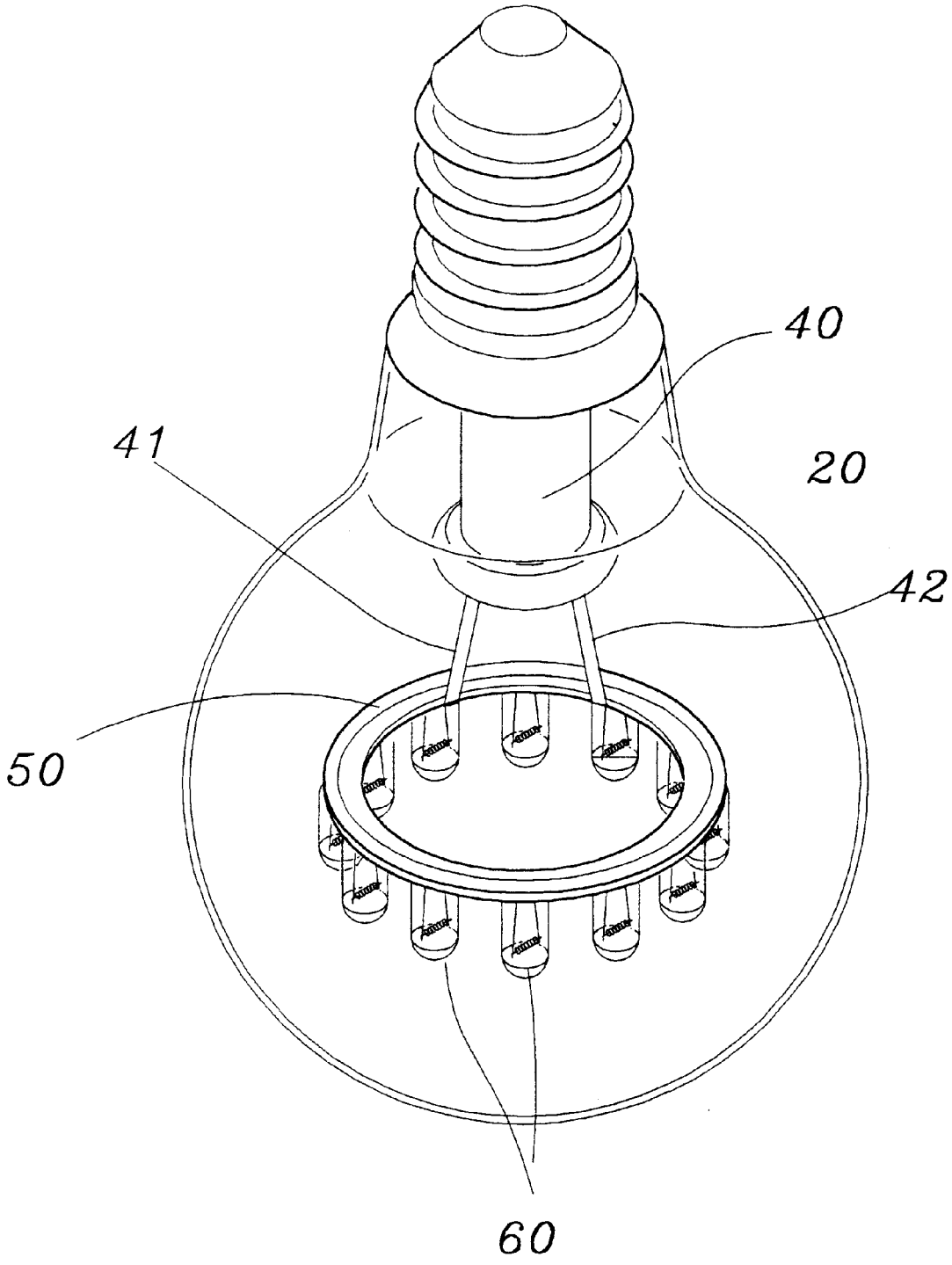
FIG. 2 is a perspective view showing the first embodiment of the present invention.

Referring to FIG. 2, the present invention is comprised of a glass lamp bulb 20, a metallic cap 30 mounted on the end of the lamp bulb 20, a core column 40 partially extending into the lamp bulb 20, an elastic frame 50 placed in the lamp bulb 20 and connected with the core column 40 and a plurality of light emitting articles such as miniature lamp beads or LEDs 60.

Figure 3:
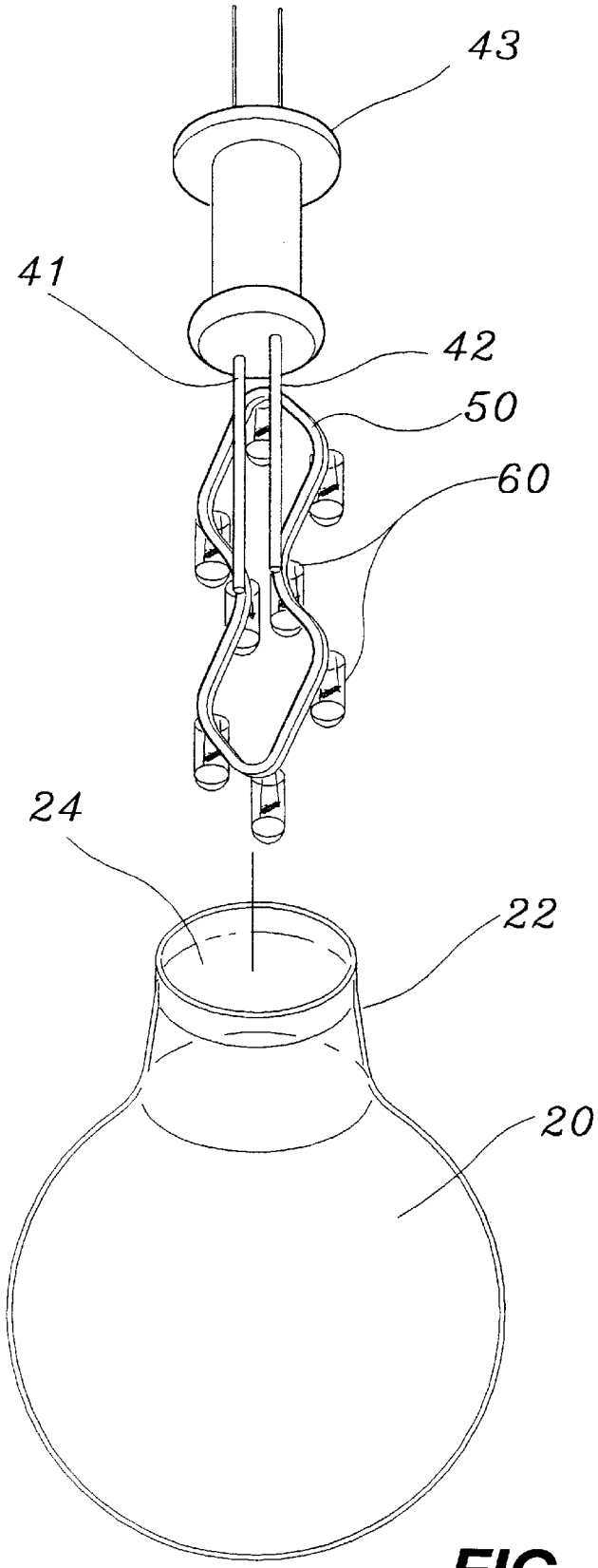
FIG. 3 is an analytic perspective view showing the state before assembling of the miniature lamp beads with the glass lamp bulb.
Figure 4:
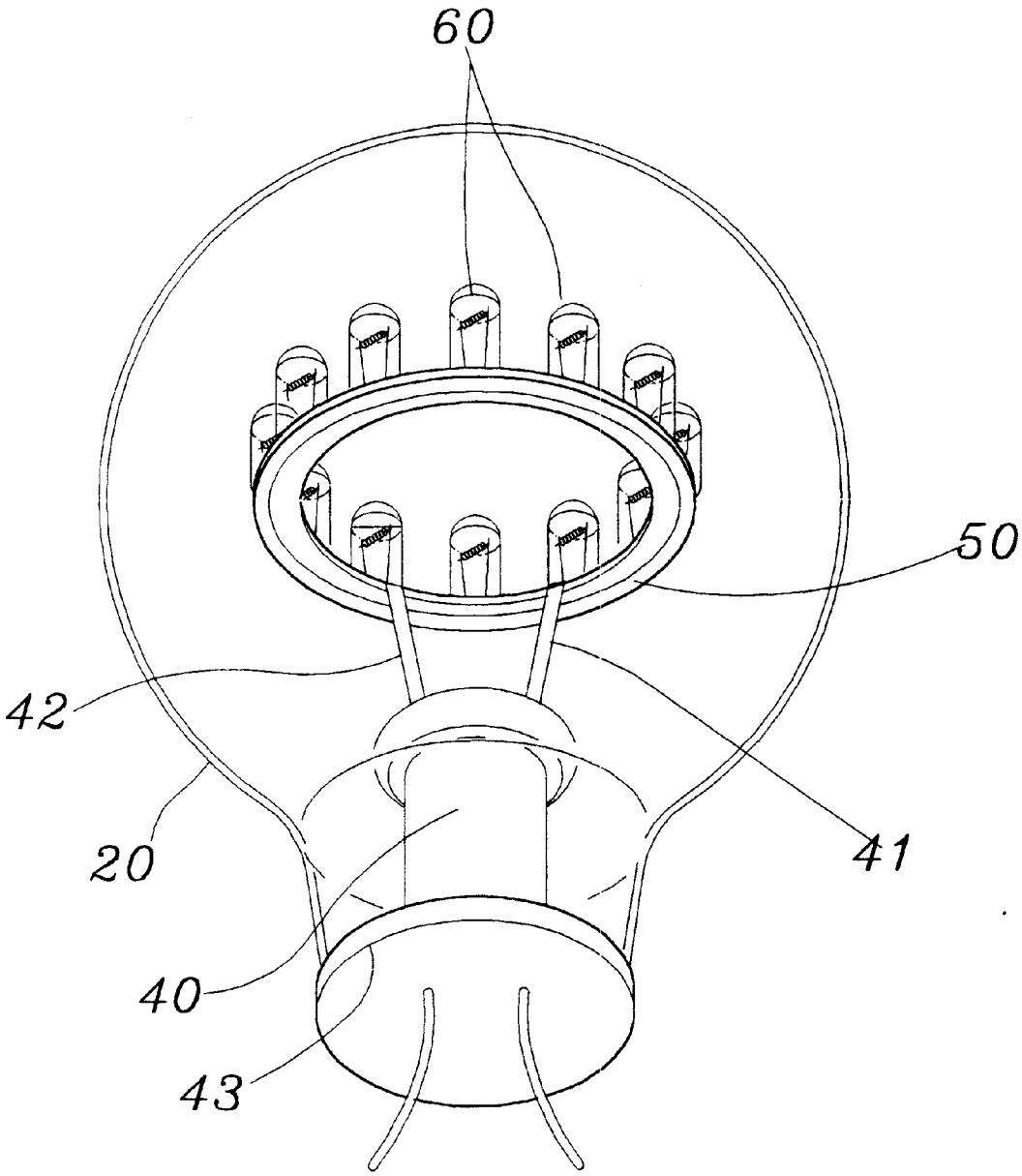
FIG. 4 is a perspective view showing the state after assembling of the miniature lamp beads on the core column as shown in FIG. 3.

Referring to FIGS. 2 and 3, in the preferred embodiment of the present invention shown, the core column 40 is provided with two flexible guide posts 41, 42 with their ends connecting with a flexible elastic frame 50 by means of conductors at two connecting points chosen on the elastic frame 50 which renders the elastic frame 50 to be elastically stretched as per its own nature. This can help the elastic frame 50 and the light emitting articles such as miniature lamp beads or LEDs 60 to stretch out elastically in the lamp bulb 20 in a more stable mode.

The elastic frame 50 can be made of suitable elastomer which can be bent, thereby it can be forcedly folded and can be restored by its elastic force when it is released. The elastic frame 50 can be made in any of various shapes in advance. In this embodiment, the elastic frame 50 is a ring when it is stretched out elastically as per its own nature, and the light emitting articles such as miniature lamp beads or LEDs 60 can be arranged around the ring.

As shown in FIG. 3, in the assembling operation in site, the glass lamp bulb 20 primarily formed is in the same way to have one end thereof formed a reduced neck 22 as an opening 24 with a smaller diameter. The above mentioned elastic frame 50 can be forcedly folded into a strip of a smaller width together with its light emitting articles such as miniature lamp beads or LEDs 60, so that it can be placed together with the miniature lamp beads or LEDs 60 into the glass lamp bulb 20, till a positioning flange 43 of the core column 40 is abutted against the edge of the opening 24. Now, the elastic frame 50 and the miniature lamp beads 60 without any force exerted thereon can stretch out elastically as per its own nature into a predetermined shape as designed in the lamp bulb 20.

Figure 5:
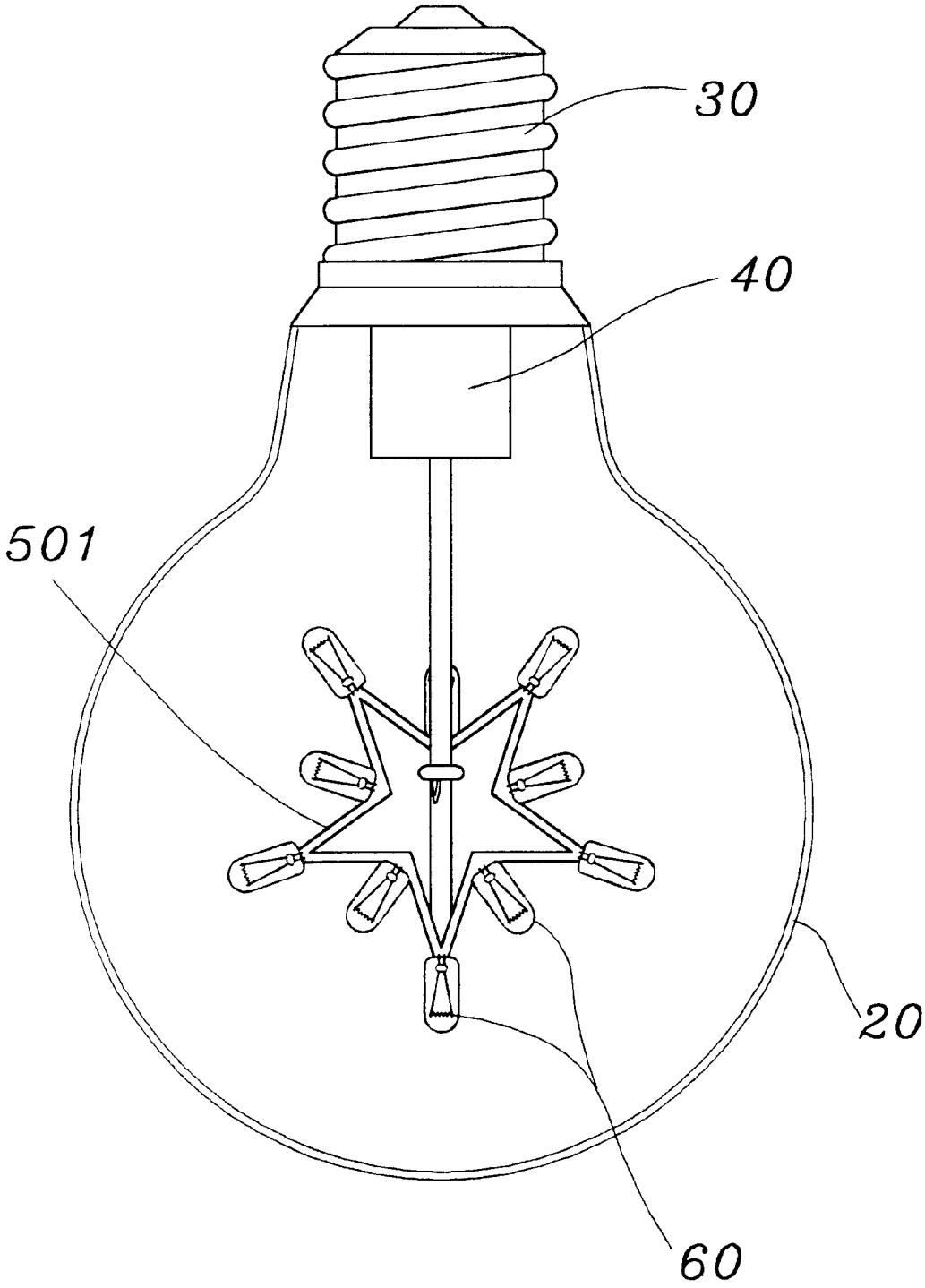
FIG. 5 shows the second embodiment of the present invention.
Figure 6:
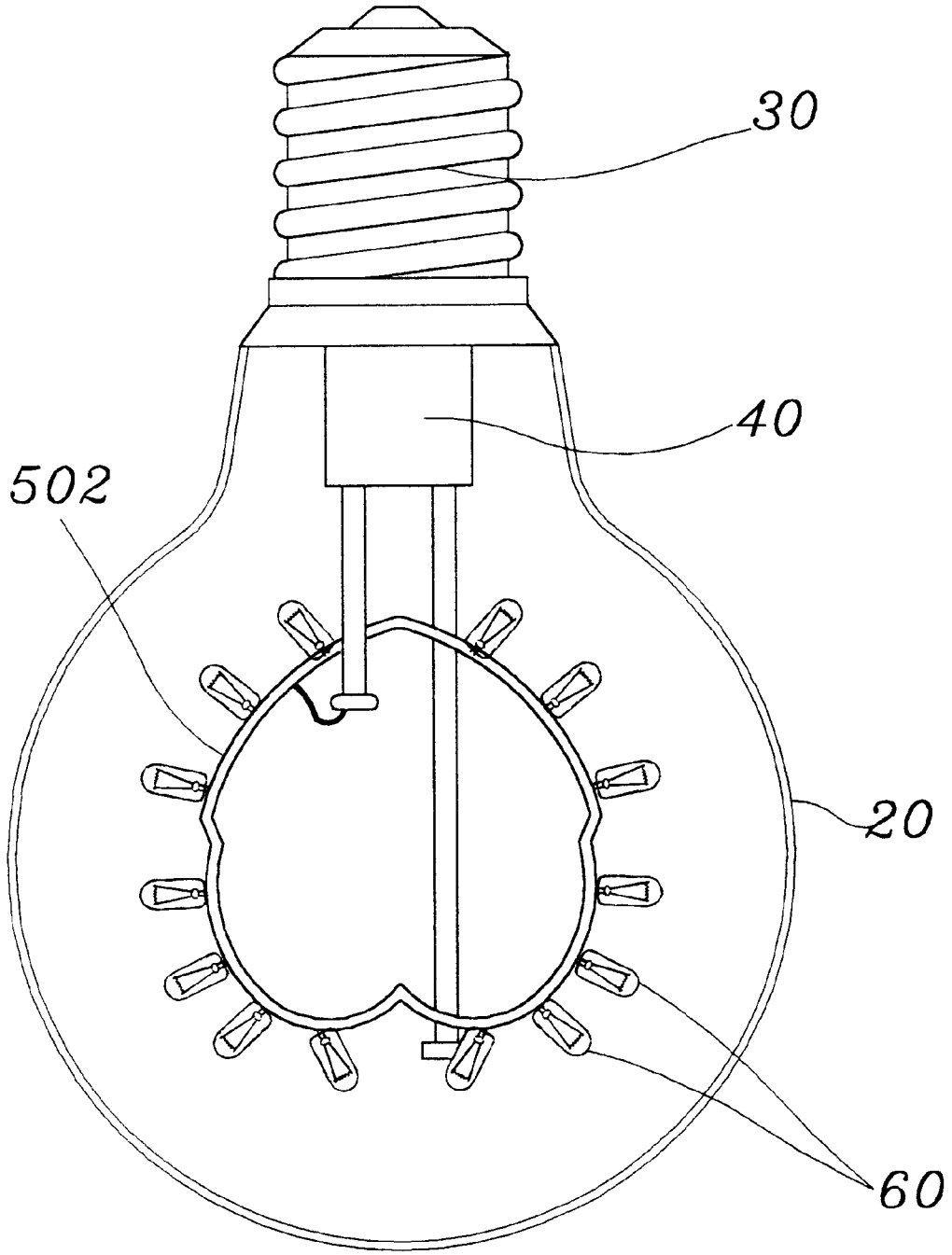
FIG. 6 shows the third embodiment of the present invention.

In the second embodiment of the present invention shown in FIG. 5, an elastic frame 501 is formed as a star; while in the third embodiment of the present invention shown in FIG. 6, an elastic frame 502 is formed as a heart. That is, the elastic frame 501 is made of flexible elastomer, and can be in any of various shapes such as a ring, a star, a heart or a continuous screw thread etc. elastically stretched as per its own nature.

The present invention is able to break through the limitation of the opening with a small diameter of a glass lamp bulb, the space in the lamp bulb can be used as far as it can be for stretching of the multiple light spots therein to elevate the decoration function of the lamp bulb and to construct a more attractive decoration scene of illumination.

The embodiment cited above is only for illustrating a preferred embodiment and not for giving any limitation to the scope of the present invention. It will be apparent to those skilled in this art that various modifications or changes can be made to and shall fall within the scope of the appended claims of the present invention.

What is claimed is:

1. A decorative lamp bulb comprising:

a) a glass lamp bulb having an end opening with a lateral width dimension;

b) a core column extending into an interior of the glass lamp bulb through the end opening, the core column having a plurality of flexible guide posts extending therefrom into the interior of the glass lamp bulb;

c) an elastic frame attached to the plurality of flexible guide posts, the elastic frame having a predetermined shape with a lateral dimension greater than the lateral width dimension of the glass lamp bulb, whereby the elastic frame is deformed to pass through the end opening of the glass lamp bulb and is restored to the predetermined shape by elasticity of the elastic frame; and, d) a plurality of light emitting devices mounted on the elastic frame.

2. The decorative lamp bulb of claim 1 wherein the light emitting devices comprise miniature lamp beads.

3. The decorative lamp bulb of claim 1 wherein the light emitting devices comprise light emissive diodes (LED).

4. The decorative lamp bulb of claim 1 wherein the core column includes a positioning flange abutting against the glass lamp bulb.

* * * * *